US006174124B1

(12) United States Patent
Haverfield et al.

(10) Patent No.: US 6,174,124 B1
(45) **Date of Patent: *Jan. 16, 2001**

(54) LOAD TRAYS FOR PERSONNEL CARRYING VEHICLES

(75) Inventors: Forrest A. Haverfield, Maplewood; Timothy S. Quellhorst, New Bremen; Donald E. Luebrecht, Ft. Jennings; Kevin A. Gilliland, Coldwater; Michael P. Gallagher, Greenville; Thomas L. Bidwell, St. Mary's; Harold A. Stammen, New Bremen; William J. Heidemann, Sidney; Paul J. Leasor, St. Marys, all of OH (US); Leif A. Norland, Holland, MI (US); Thomas W. Linn, St. Henry, OH (US); Joe H. Knapschaefer, Coldwater, OH (US); Rob J. Stauffer, New Bremen, OH (US); David B. Smith, Worthington, OH (US); John McClusky, Pittsburgh, PA (US)

(73) Assignee: Crown Equipment Corporation, New Bremen, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/144,468

(22) Filed: Sep. 1, 1998

Related U.S. Application Data

(63) Continuation-in-part of application No. 08/725,975, filed on Oct. 4, 1996, now abandoned

(60) Provisional application No. 60/004,850, filed on Oct. 5, 1995, provisional application No. 60/025,970, filed on Sep. 9, 1996, and provisional application No. 60/057,427, filed on Sep. 2, 1997.

(51) Int. Cl.[7] ..... B66F 9/06

(52) U.S. Cl. ..... 414/642; 414/643; 182/148

(58) Field of Search ..... 414/639, 640, 414/641, 642, 643; 187/222, 231, 233, 234; 182/141, 148

(56) References Cited

U.S. PATENT DOCUMENTS

| | | |
|---|---|---|
| D. 347,720 | 6/1994 | Tamura et al. . |
| 2,035,294 | 3/1936 | Black . |
| 2,938,595 | 5/1960 | Miller . |

(List continued on next page.)

FOREIGN PATENT DOCUMENTS

| | | |
|---|---|---|
| 0 557 685 | 9/1993 | (EP) . |
| 885 824 | 12/1961 | (GB) . |
| 1 358 384 | 7/1974 | (GB) . |
| WO 98 09910 | 3/1998 | (WO) . |

*Primary Examiner*—Robert P. Olszewski
*Assistant Examiner*—Gerald J. O'Connor
(74) *Attorney, Agent, or Firm*—King & Schickli PLLC

(57) ABSTRACT

A multi-task capable work assist vehicle is designed for transporting an operator and items to be handled by the operator and for elevating the operator with such items supported upon a load tray elevated with the operator. Preferably the load tray is mounted for positioning along a telescoping mast which supports and elevates the operator. A load deck or load platform is provided on a body of the vehicle in addition to the load tray so that items such as packages, tools, parts, merchandise and the like can be carried by the vehicle. Load shelves may also be provided adjacent the load deck to add flexibility and capacity to the load carrying capability of the vehicle. Uses of the vehicle include order picking, in-house service maintenance, stock management, cargo delivery and the like. It is designed to be compact in size and highly maneuverable for use in narrow storage aisles and tight quarters.

21 Claims, 16 Drawing Sheets

U.S. PATENT DOCUMENTS

| | | | | |
|---|---|---|---|---|
| 2,989,140 | * | 6/1961 | Hill et al. | 182/148 X |
| 3,172,500 | * | 3/1965 | Dolphin et al. | 182/148 X |
| 3,236,329 | | 2/1966 | Price . | |
| 3,452,837 | * | 7/1969 | Herrell et al. | 182/17 |
| 3,556,249 | * | 1/1971 | Jackson | 182/148 X |
| 3,817,346 | * | 6/1974 | Wehmeyer | 182/148 X |
| 3,844,382 | * | 10/1974 | Mecklenburg | 187/9 |
| 3,882,964 | * | 5/1975 | Schellenberg | 182/63 |
| 3,934,681 | * | 1/1976 | Herrell | 182/148 X |
| 3,963,096 | * | 6/1976 | Jones | 182/15 |
| 4,015,686 | * | 4/1977 | Bushnell | 182/148 |
| 4,059,170 | * | 11/1977 | Young | 180/54.1 |
| 4,101,005 | * | 7/1978 | Fewkes | 187/17 |
| 4,258,825 | * | 3/1981 | Collins | 182/14 |
| 4,378,658 | * | 4/1983 | DeLorean | 49/379 |
| 4,427,094 | * | 1/1984 | Winkelblech | 182/148 X |
| 4,529,063 | * | 7/1985 | Kishi | 187/9 |
| 4,657,112 | * | 4/1987 | Ream et al. | 182/63 |
| 5,082,085 | * | 1/1992 | Ream et al. | 182/148 X |
| 5,174,415 | | 12/1992 | Neagle et al. . | |
| 5,203,425 | * | 4/1993 | Wehmeyer | 182/19 |
| 5,273,132 | * | 12/1993 | Sasaki et al. | 182/148 |
| 5,544,718 | * | 8/1996 | Schumacher | 182/129 |
| 5,755,306 | * | 5/1998 | Kraemer et al. | 182/148 |

* cited by examiner

LOAD TRAYS FOR PERSONNEL CARRYING VEHICLES

CROSS REFERENCE TO RELATED APPLICATIONS

This application is a continuation-in-part of U.S. patent application Ser. No. 08/725,975 filed Oct. 4,1996, abandoned in favor of U.S. patent application Ser. No. 09/285,378 now U.S. Pat. No. 5,992,572, and entitled PERSONNEL CARRYING VEHICLE, which claims benefit of earlier filed U.S. Provisional Pat. Appl. Ser. No. 60/004,850, filed Oct. 5, 1995, and Ser. No. 60/025,970, filed Sept. 9, 1996, all of which are hereby incorporated by reference. This application also claims benefit of U.S. Provisional Pat. Appl. Ser. No. 60/057,427 which was filed Sept. 2, 1997, and entitled LOAD TRAYS FOR PERSONNEL CARRYING AND MATERIALS HANDLING VEHICLE and is hereby incorporated by reference. This application is also related to previously filed U.S. patent applications Ser. No. 09/060,661, and Ser. No. 09/060,662, both of which were filed Apr. 15, 1998, and are incorporated herein by reference.

BACKGROUND OF THE INVENTION

The present invention relates in general to electric powered personnel carrying vehicles that are particularly useful in transporting items retrieved from shelves in a warehouse, or as a work platform which allows an operator to be raised approximately six feet or more into the air, for example to retrieve or place items of merchandise on shelves of a retail store and, more particularly, to load trays which can be utilized on such vehicles to support items to be handled by operators utilizing such vehicles.

Small parts picking is commonly done by personnel manually pushing carts equipped with several shelves and a low level ladder which the operator climbs for reaching stock items up to nine feet high. Higher elevation picking, up to 12 feet, is accomplished with large manual push-in-place mobile ladder stands. Both the carts and mobile ladder stands require the operator to climb up and down while manually holding the goods.

A compact aerial lift vehicle which can be used for parts picking is disclosed in U.S. Pat. No. 5,273,132. The vehicle is separable into several parts for storage and can be controlled by an operator supported upon a platform which can be elevated along a vertical post member removably mounted upon a body of the vehicle. Unfortunately, the aerial lift vehicle of the '132 patent is of limited utility since only a small-sized basket is provided for the operator such that the operator must still manually hold items too large to fit into the basket. Further, there is no provision for supporting items on the body of the vehicle for transportation of those items utilizing the vehicle.

Accordingly, there is a need for an improved personnel carrying vehicle which includes a load tray mounted on and movable with an expandable mast of the vehicle so that an operator of the vehicle does not need to manually hold any items which can be handled by the operator utilizing the vehicle. Alternately, or preferably in addition to the mast mounted load tray, the vehicle would include a load deck or load platform for carrying items on the vehicle for transportation of the items.

SUMMARY OF THE INVENTION

The need is met by the invention of the present application wherein a multi-task capable work assist vehicle is designed for transporting an operator and items to be handled by the operator and for elevating the operator with such items supported upon a load tray elevated with the operator so that the operator does not have to manually hold items during travel, elevation or descent. Preferably, the load tray is mounted for positioning along a telescoping mast which supports and elevates the operator. A load deck or load platform may be provided on a body of the vehicle in addition to the load tray or alone so that items such as packages, tools, parts, merchandise and the like can be carried by the vehicle. Load shelves may also be provided adjacent the load deck to add flexibility and capacity to the load carrying capability of the vehicle. The utility of the vehicle is optimized by providing both a load tray and a load deck and/or load shelves on the vehicle which form preferred configurations of the vehicle. Uses of the vehicle include order picking, in-house service maintenance, stock management, cargo delivery and the like. It is designed to be compact in size and highly maneuverable for use in narrow storage aisles and tight quarters.

It is, thus, an object of the present invention to provide a personnel carrying vehicle comprising a self propelled, steerable body, a mast attached to and extending upwardly from the body, a personnel compartment attached to the mast and a load tray mounted to the mast for supporting items during travel of the vehicle and elevation or descent of the operator; to provide a personnel carrying vehicle comprising a self propelled, steerable body, a mast attached to and extending upwardly from the body, a personnel compartment attached to the mast and a load deck on the body of the vehicle for supporting items during travel of the vehicle; to provide a personnel carrying vehicle comprising a self propelled, steerable body, a mast attached to and extending upwardly from the body, a personnel compartment attached to the mast and a vertically movable load tray mounted to the mast for supporting items during travel of the vehicle and elevation or descent of the operator; and, to provide a personnel carrying vehicle comprising a self propelled, steerable body, a mast attached to and extending upwardly from the body, a personnel compartment attached to the mast, a load tray mounted to the mast for supporting items during travel of the vehicle and elevation or descent of the operator and a load deck on the body of the vehicle for supporting items during travel of the vehicle.

Other objects and advantages of the invention will be apparent from the following description, the accompanying drawings and the appended claims.

DETAILED DESCRIPTION OF THE INVENTION

Figure 1:
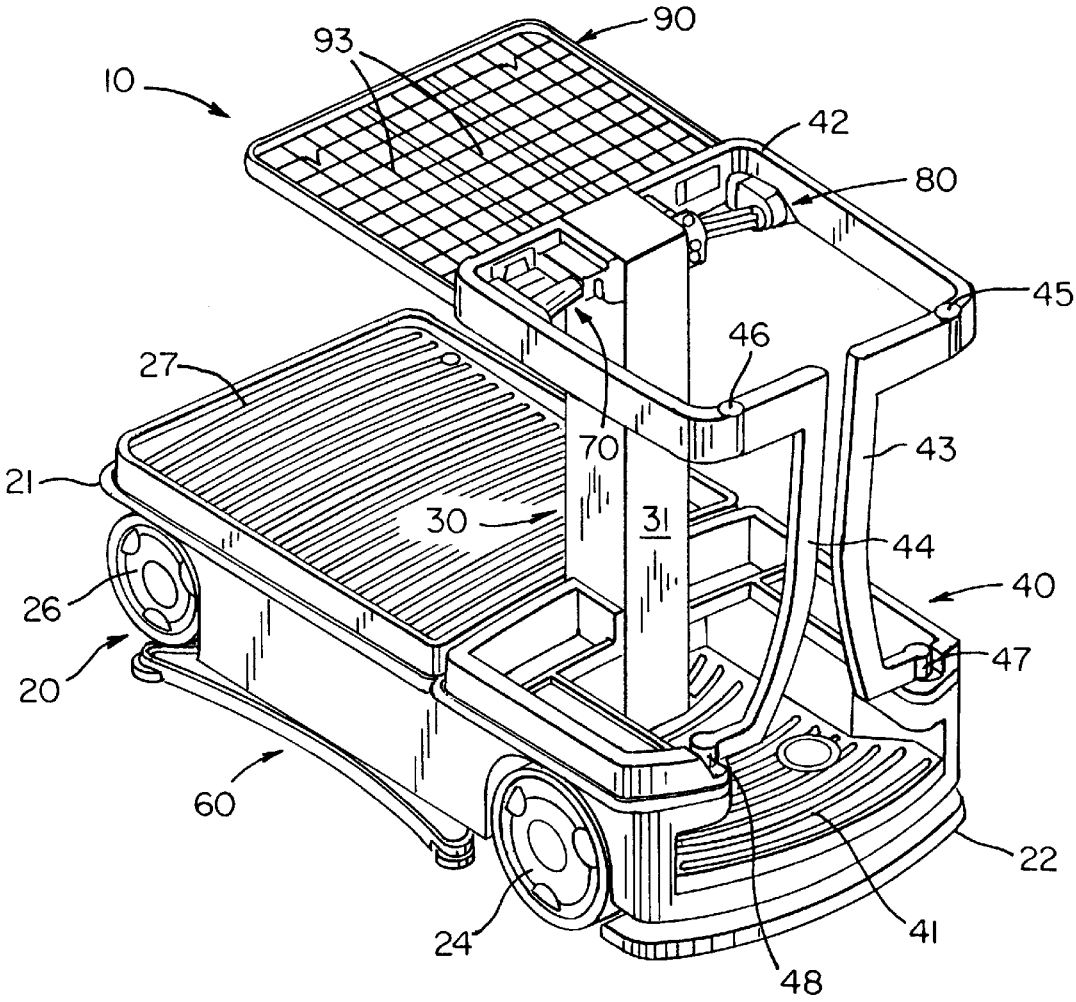
FIG. 1 is a perspective view of a personnel carrying vehicle including the invention of the present application.

Referring now to FIGS. 1–4, a personnel carrying vehicle 10 includes a self-propelled, steerable body 20 having a front 21 and a rear 22. A pair of drive wheels 24 are mounted near the rear 22 of the body 20, and a pair of caster wheels 26 are mounted near the front 21 of the body 20. A load deck or platform 27 is removably placed at the forward end of the vehicle 10.

A mast 30 is attached to and extends upwardly from the body 20. As shown in FIG. 2, the mast 30 includes three nested sections 31, 32, and 33. A hydraulic cylinder is employed to extend the mast 30 from its retracted position, shown in FIG. 1, to its fully extended position as shown in FIG. 2. While three mast sections are illustrated, the number of mast sections actually used can vary.

A personnel compartment 40 is attached to the mast 30, and specifically to the outer or upper section 31 of the mast 30. The personnel compartment 40 includes a floor 41 removably attached to the mast 30, a rail member 42 mounted to the mast 30 and extending around the sides and front of the personnel compartment 40, and a pair of gate members 43, 44 pivotally attached to the rail member 42 at 45 and 46, respectively, and to the floor at 47 and 48, respectively. The floor 41 is hinged at the front of the compartment to permit access to electrical connection terminal blocks and other equipment beneath the floor 41 without requiring the compartment 40 to be raised. The gate members 43, 44 are movable from a closed position, as shown in FIG. 1, to an open position wherein the gate members extend into the personnel compartment 40.

Figure 2:
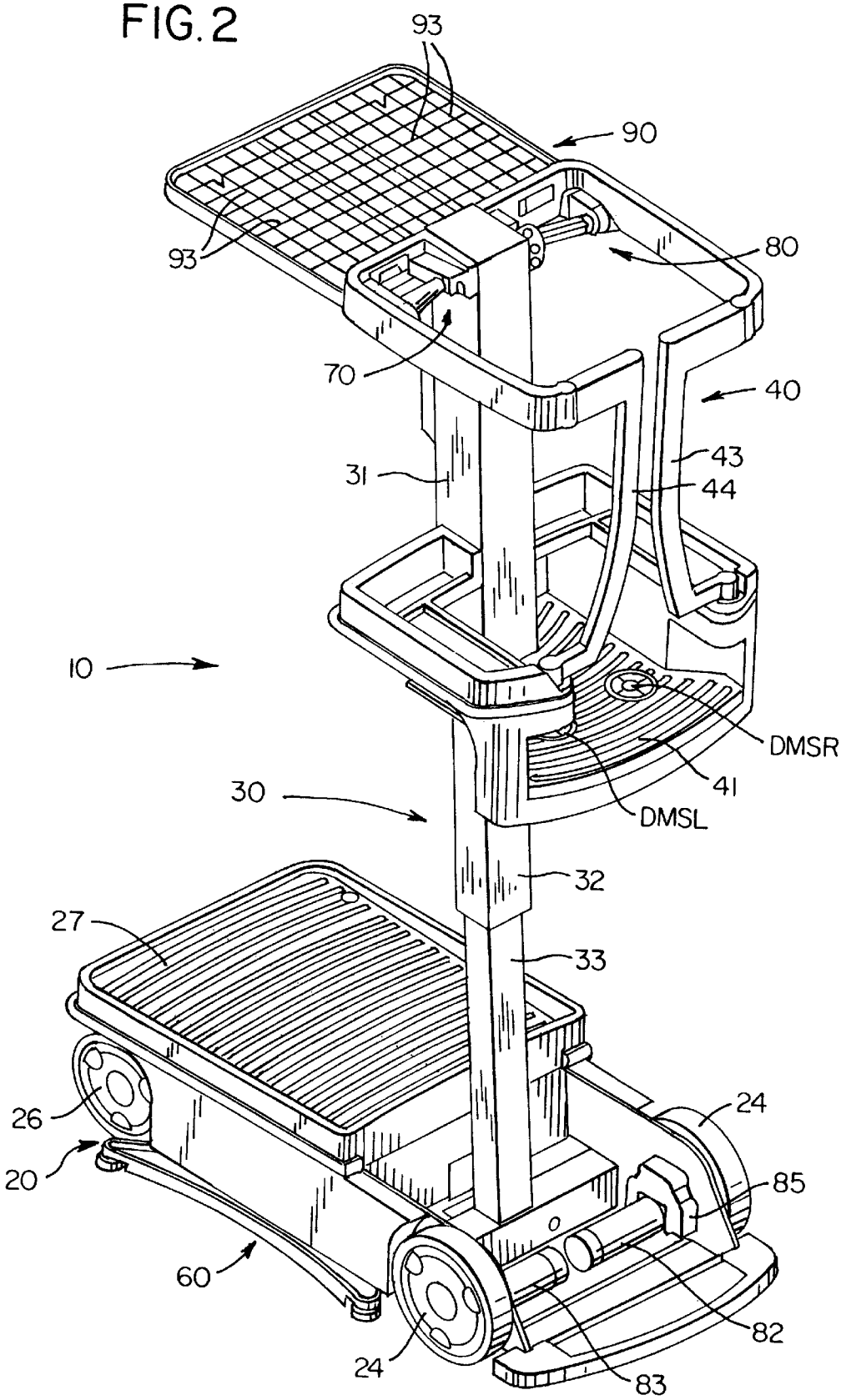
FIG. 2 is a perspective view of the vehicle of FIG. 1 with the operator's platform or compartment and associated load tray in the raised position.
Figure 3:
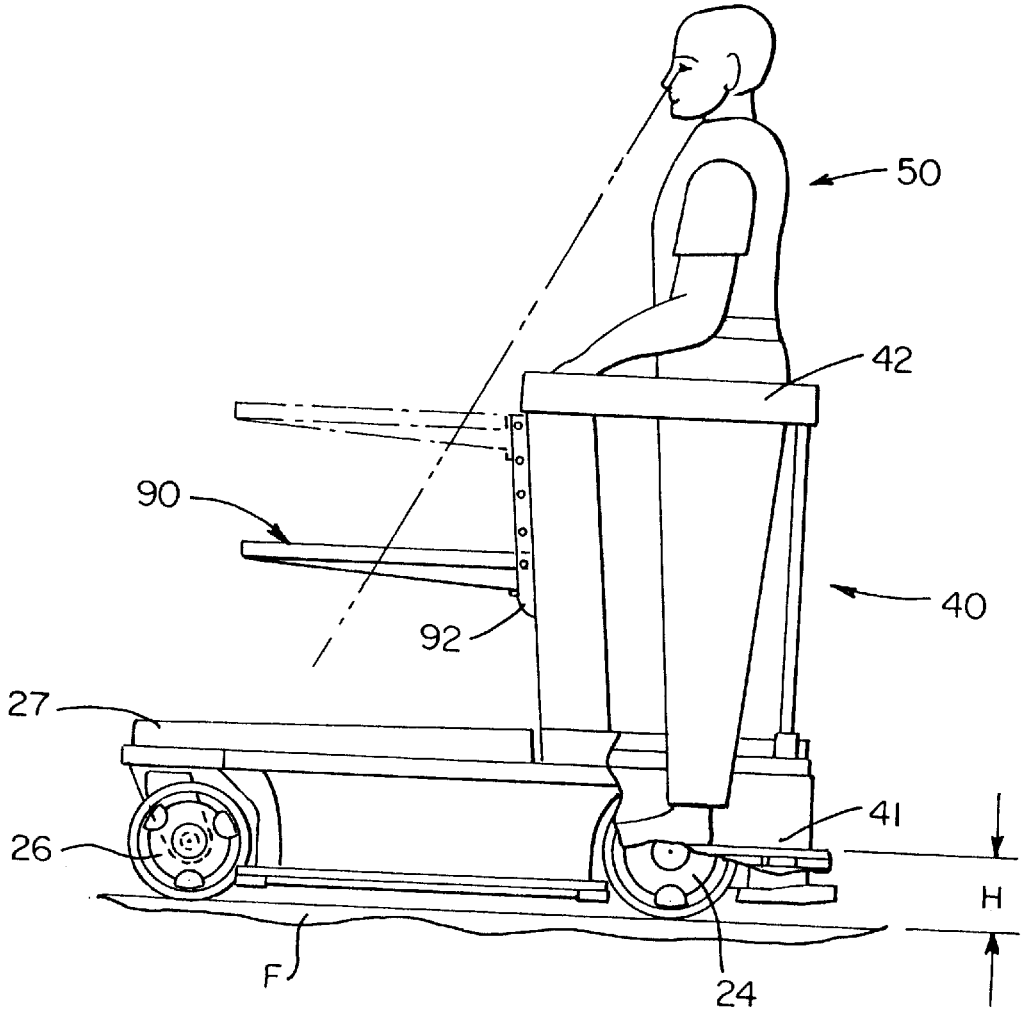
FIG. 3 is a side elevational view of the vehicle of FIG. 1.
Figure 4:
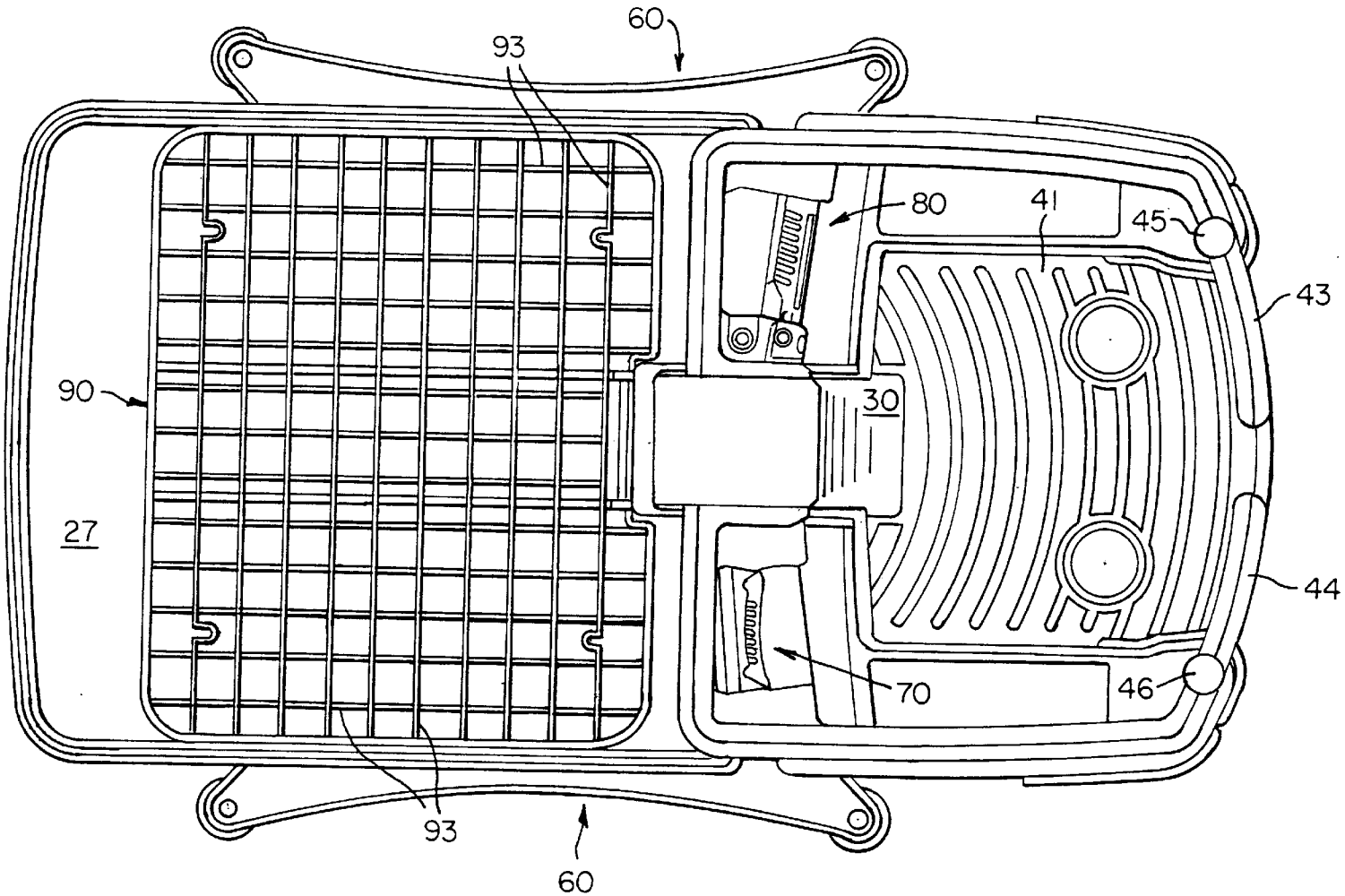
FIG. 4 is a plan view of the vehicle shown in FIG. 1.

As shown in FIGS. 1–3, the rail member 42, as well as the top of the mast 30, is placed at approximately waist height of an operator 50 (FIG. 3) standing within the personnel compartment 40. The mast 30 does not extend substantially above the rail 42, thus giving the operator 50 unobstructed access to anything above the top edge of the rail 42.

As shown in FIG. 2, the lower mast member 33 is attached to the body 20 and extends upwardly and forward of the vehicle at an angle of approximately 5° from the vertical, see FIG. 3. As the mast 30 is extended, the personnel compartment 40 is moved upwardly and forwardly.

The personnel compartment 40 or operator's compartment benefits by the 5° tilt of the mast 30 in that the upper portion of the compartment, near the waist of the operator, is larger than the floor, thus accommodating the operator comfortably without increasing the length of the vehicle 10.

Referring again to FIG. 1, a detachable rail guide assembly 60 is mounted on the body 20 between the front and rear wheels. A rail guide assembly 60 is mounted on each side of the vehicle and is used to assist in guiding the vehicle into and through an aisle between closely spaced storage racks.

The operator 50 is provided with a pair of control handles, a steering control assembly 70 and a traction control assembly 80. When the vehicle is in operation, the operator must have one hand (the left hand as shown in FIG. 1) on the steering control, and the other hand (the right hand, as shown in FIG. 1) on the traction control, and both feet on the floor of the operator's compartment, and specifically on dead man switches DMSL and DMSR, shown in FIG. 2. This ensures a four point stance, providing for operator stability and that the operator's hands and feet are within the operator's compartment anytime the vehicle is being moved or during lifting or lowering operations.

Referring to FIG. 2, a pair of traction motors 82, 83 are mounted in a traction motor compartment located inside the body 20 and beneath the floor 41 of the operator's compartment. A cover plate, which normally encloses the traction motor compartment, has been removed to reveal the contents of the compartment. The traction motors are connected to the axle of the wheels 24 through gear boxes 85, only one of which is shown. As shown in FIG. 2, the center axis of each traction motor is below the axis of the wheels 24, thus permitting the floor 41 of the compartment 40 to be positioned as close to the ground level as possible, at a height H, approximately 7 inches above the floor F, see FIG. 3.

A load tray 90 may also be mounted on the mast 30. As illustrated in FIG. 3, the load tray 90 may be attached to the mast 30 using an attachment strip 92 which extends downwardly from the top of the upper mast section 31 and is provided with spaced apart pin openings which permit easy attachment of the load tray 90 at different levels relative to the upper rail 42. The load tray 90 may take various configurations.

The illustrated load tray 90 includes outside or peripheral members and a plurality of interior wires 93. Generally, the interior wires 93 are designed to help support a load while at the same time, the wires 93 are arranged to facilitate the operator's view of any material on the load platform 27. The attachment of the load tray 90 to the mast as illustrated in FIG. 3 permits the load tray 90 to pivot upwardly if it is inadvertently lowered onto an obstacle which has been placed on the load platform 27.

Reference is now made to FIGS. 5, 5A and 6–8 which illustrate a preferred embodiment of the load tray 90 of the present invention. The load tray 90 is shown connected to an attachment mechanism 100, which includes a C-shaped member 110, and an elevator or elevator assembly 120. The C-shaped member 110 includes a back wall member 112, side wall members 114 and a pair of partial front wall members 116. The back wall member 112 includes several spaced apart openings or slots 118 and a chain inspection opening which allows access to cover plate 119.

The elevator assembly 120 includes a main frame member or plate 122 that has mounted thereon several rollers, namely, a pair of upper rollers 124 and a pair of middle rollers 126, which are placed between the back wall member 112 and the partial front wall members 116; these rollers 124,126 allow the elevator assembly 120 to move freely vertically while keeping the assembly within the track formed between the front and back wall members 116, 112. The elevator assembly 120 also includes a pair of upper guide rollers 128 and a pair of lower guide rollers 130. The rollers 128,130 engage the inner surface of the partial front wall members 116 and prevent twisting of the elevator assembly 120.

Springs 140 extend between pins 142 attached to the C-shaped member 110 and pins 144 attached to the elevator assembly 120. The springs 140 assist in overcoming the weight of the load tray 90 and elevator assembly 120. The load tray 90 is supported on the elevator assembly 120 by a pin 150 that extends through openings 152 in brackets 154 that extend outwardly from the plate 122. This arrangement allows the load tray 90 to be rotated from the horizontal position, where arms 156 engage the front wall members 116, to a vertical position, for storage and for vertical repositioning.

The load tray 90 is supported in a selected position by a spring loaded support mechanism 160 which includes a load tray support pin 162, a spring 164 to bias the pin 162 toward the slots 118 in the back wall member 112, and an arm or link 157 that extends outwardly to an actuating mechanism 170 that is attached to the load tray 90 near or at the midpoint on the pin 150. The actuating mechanism 170 is provided with a arcuate slot 172. A pin 174 of the link 157 extends through the slot 172 while another pin 176 of the link 157 is coupled to the pin 162. Thus, as the load tray 90 is pivoted upwardly toward the vertical position, the end of the slot 172 engages the pin 174 and withdraws the support pin 162 from one of the slots 118 with which the support pin 162 is currently engaged, thereby allowing the vertical elevation of the load tray 90 with respect to the operator's compartment 40 to be changed.

A shaft 180 extends downwardly from the elevator assembly 120. A spring 182 urges the shaft 180 down. The spring biased shaft 180 serves two purposes: the first is to provide a cushion when the elevator assembly 120 reaches the bottom of its travel and is about to engage an end plate 185 at the lower end of the C-shaped member 110; and, the other is to provide additional resistance to the lowering of the load tray 90 in preparation for stowing the load tray 90 in a vertical position.

Figure 5:
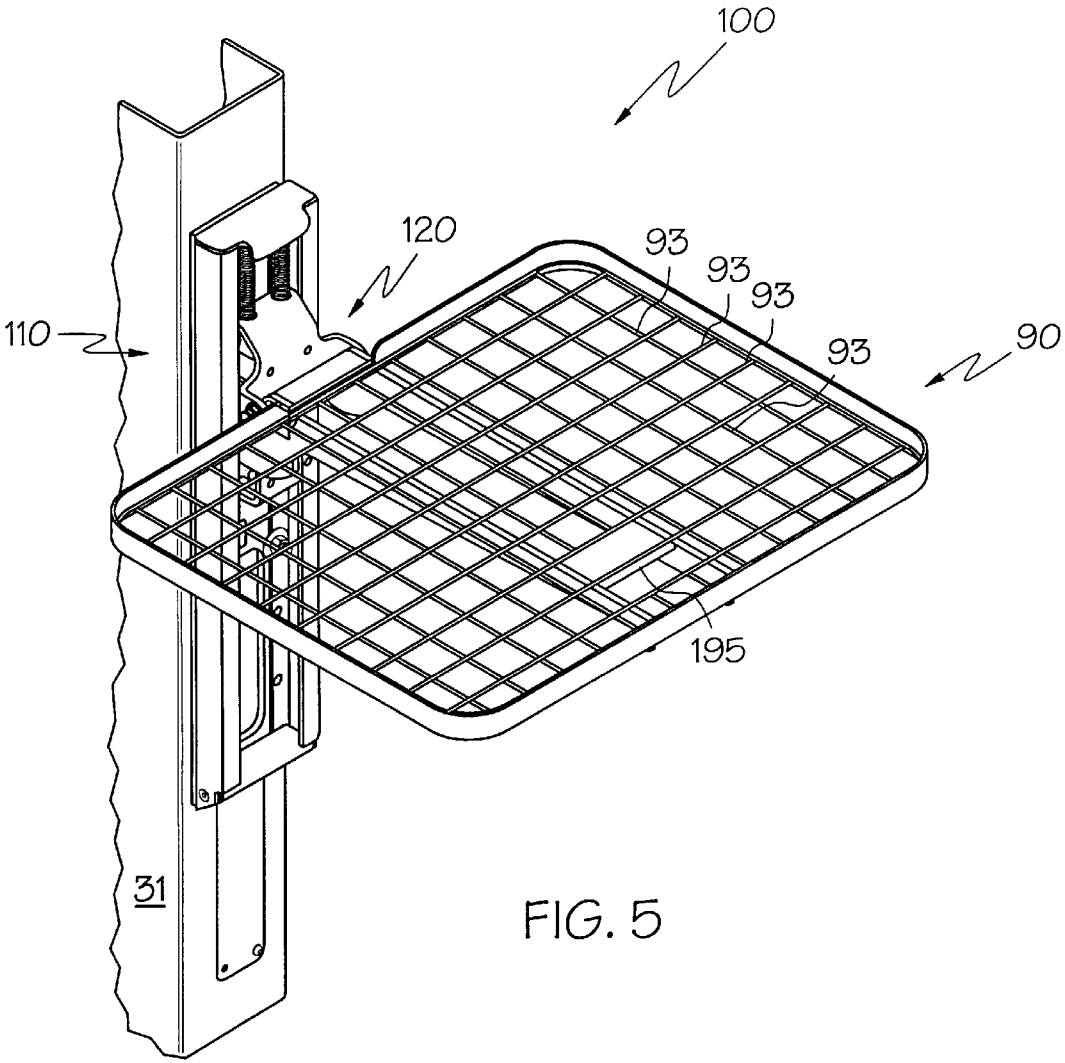
FIG. 5 is a perspective view of a portion of an upper section of a mast of the vehicle of FIG. 1 showing a preferred embodiment of the load tray and an arrangement for mounting the load tray to the upper section of the mast.
Figure 5A:
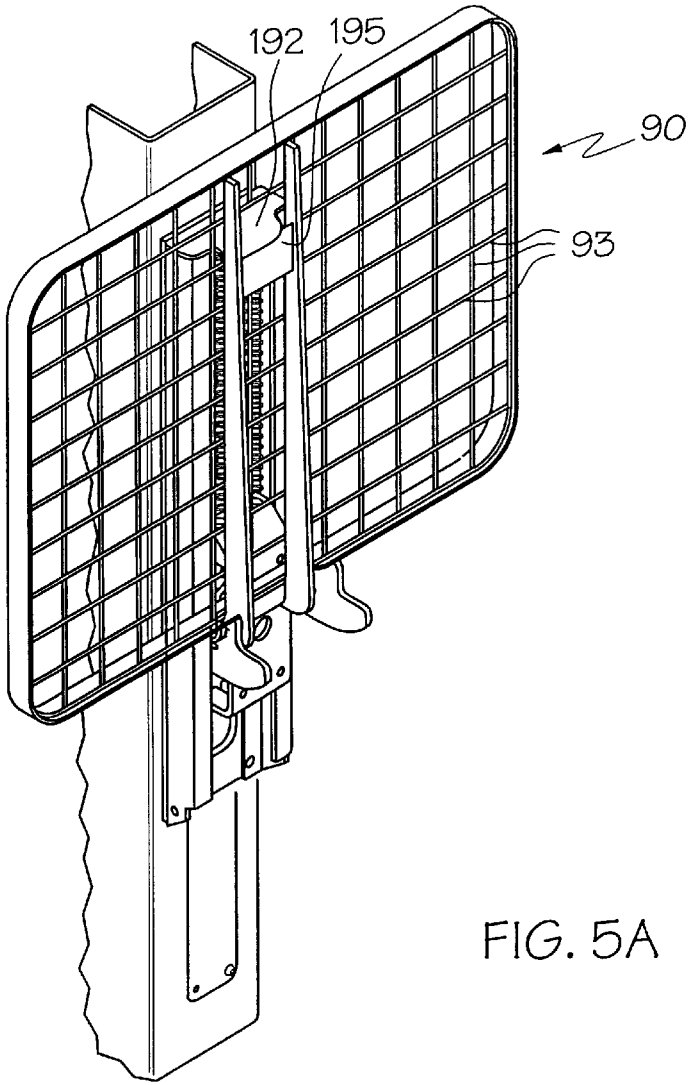
FIG. 5A is a perspective view corresponding to FIG. 5 but with the load tray stowed in its vertical storage position.
Figure 6:
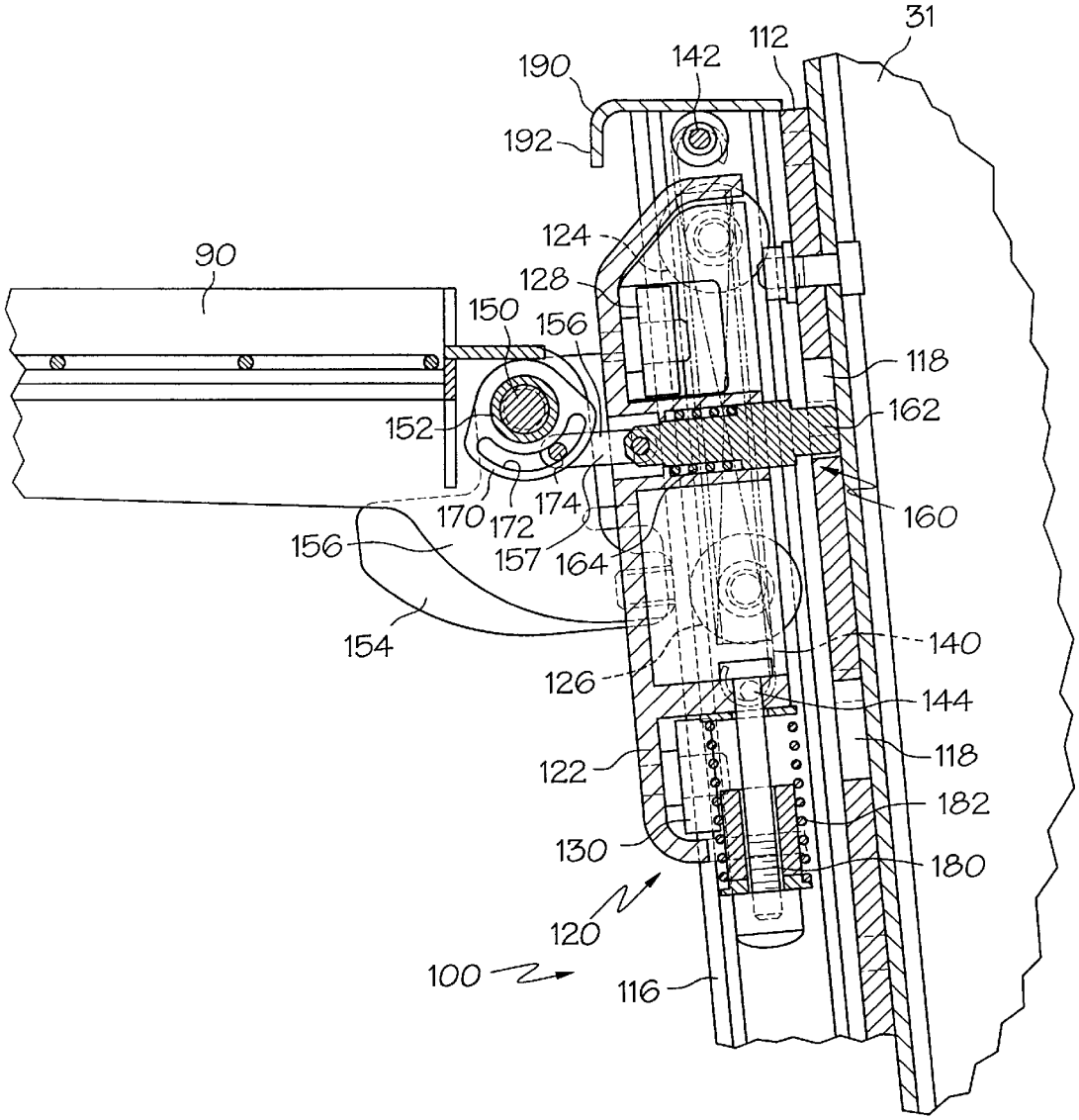
FIG. 6 is a partially sectioned side view of the load tray mounting arrangement of FIG. 5.
Figure 7:
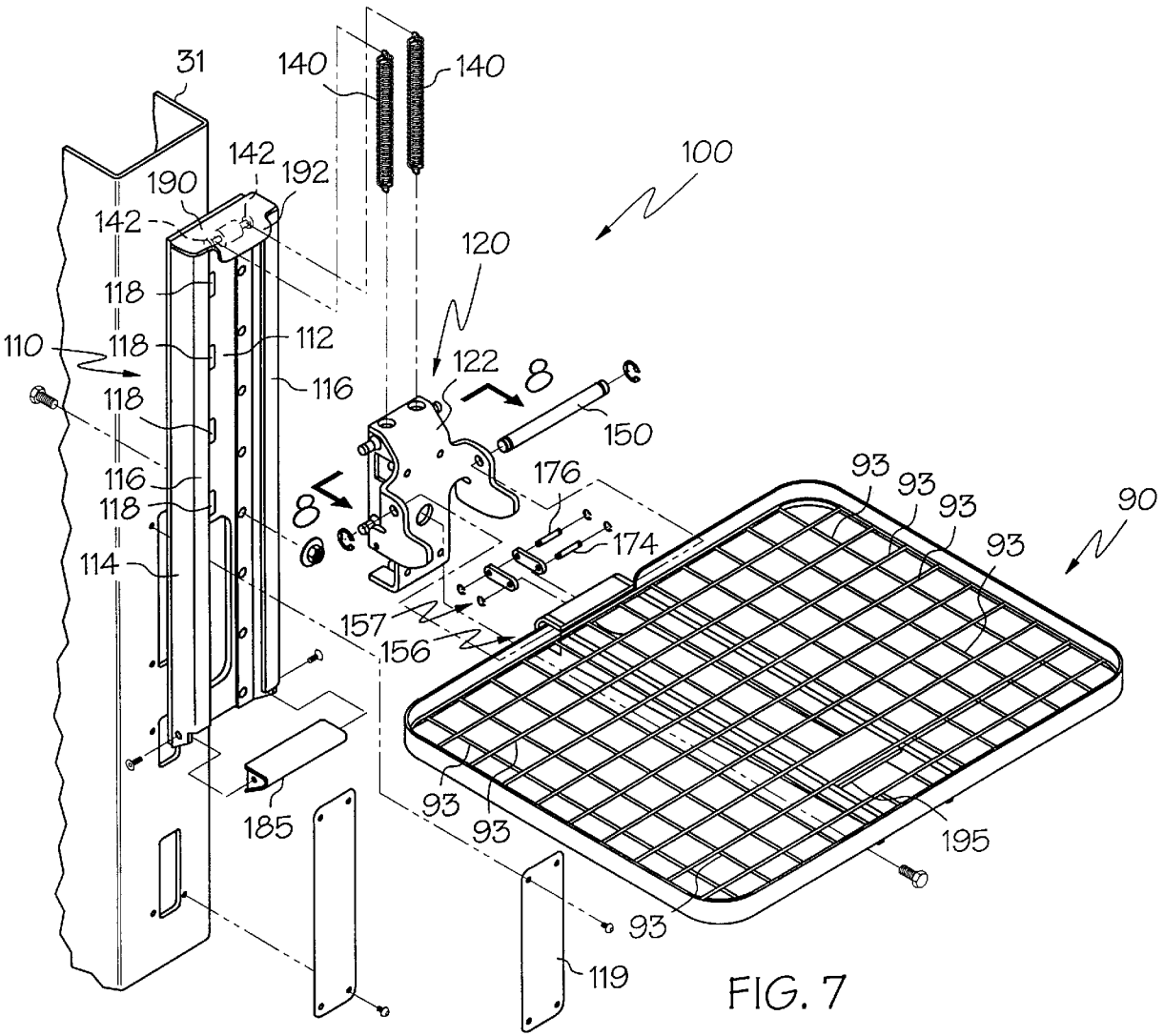
FIG. 7 is an exploded view of the load tray and load tray mounting arrangement of FIG. 5 with some parts removed for sake of clarity of illustration.

The C-shaped member 110 is provided with a cap 190 having a downwardly extending lip 192. The load tray 90 is provided with a plate 195 for engagement with the lip 192. As shown in FIG. 5A, the load tray 90 may be stowed in the vertical position by pushing down on the load tray 90, placing the plate 195 behind the lip 192, and allowing the springs 140, 182 to move the load tray 90 up so that the plate 195 is trapped behind the lip 192. For removal from the stowed position, the load tray 90 is pushed down against the force of the springs 140, 182 and pivoted downwardly to one of its horizontal service positions along the mast 30.

Figure 8:
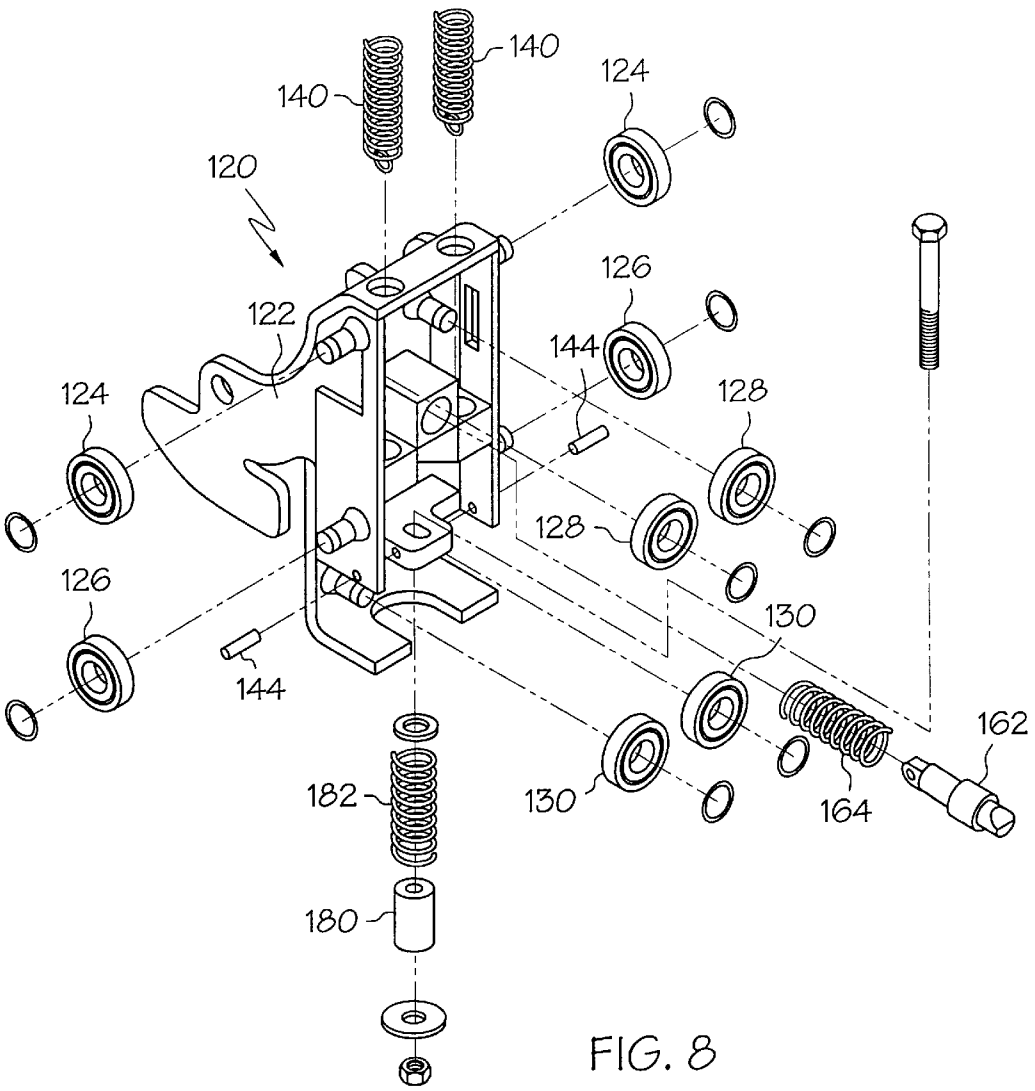
FIG. 8 is an exploded view of an elevator assembly of the load tray mounting arrangement as viewed from the mast of the vehicle along the view line 8—8 of FIG. 7.
Figure 8A:
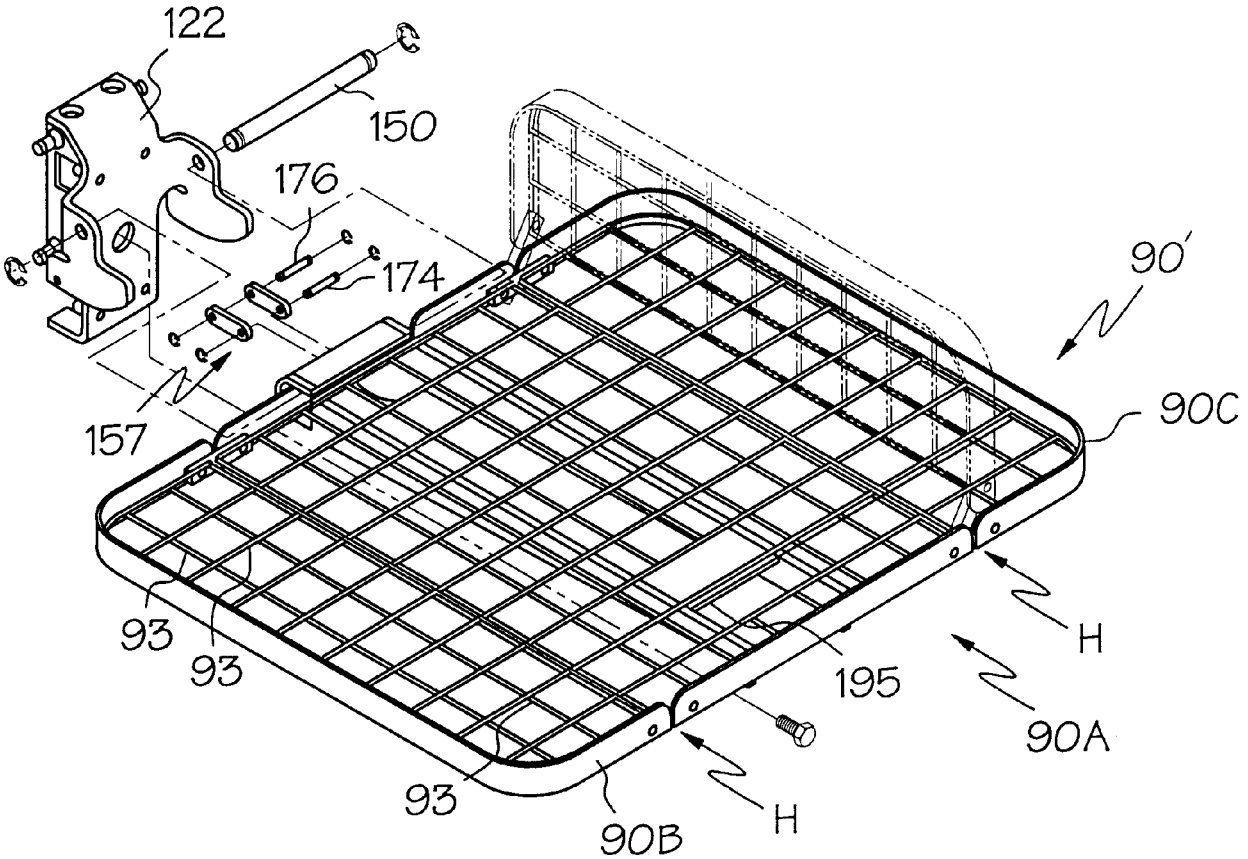
FIG. 8A is a perspective view of a folding load tray embodiment of the present application.

As shown in FIG. 8A, an alternate embodiment of the load tray 90' is formed in three sections: a center section 90A and a pair of folding outer sections 90B, 90C. A pair of hinges H are placed between the center section 90A and each of the outer sections 90B, 90C to allow either or both of the outer sections 90B, 90C to be folded on top of the center section 90A. In some load carrying situations, it might be necessary or desirable to place a tall object directly on the load platform 27 while placing smaller packages on the load tray 90', or the operator may need less restricted access to an object or bin on the load deck, which is readily possible with the folding load tray 90' as illustrated. While the outer or side sections 90B, 90C of the folding load tray 90' as illustrated are hinged for folding, it is also possible to have any half of the load tray 90, i.e., up to about 50% of the load tray 90, hingedly supported relative to the other half of the load tray 90 which would accommodate a somewhat larger load on the load platform 27. Thus, the front half or one side half of the load tray could be mounted to be folded onto the remaining half of the load tray.

Figure 9:
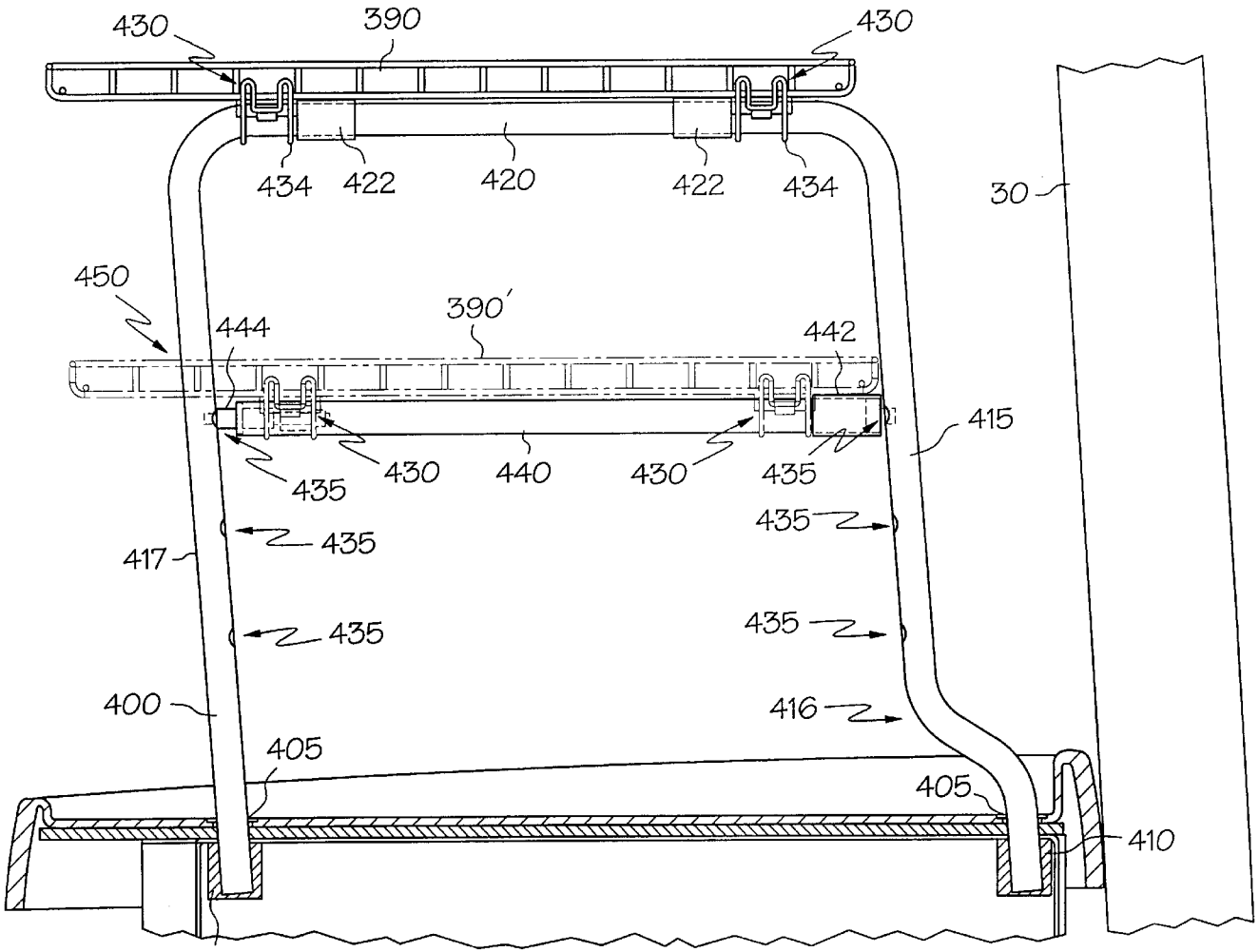
FIG. 9 is a side view of a personnel carrying vehicle including a load shelf arrangement of the present application.
Figure 10:
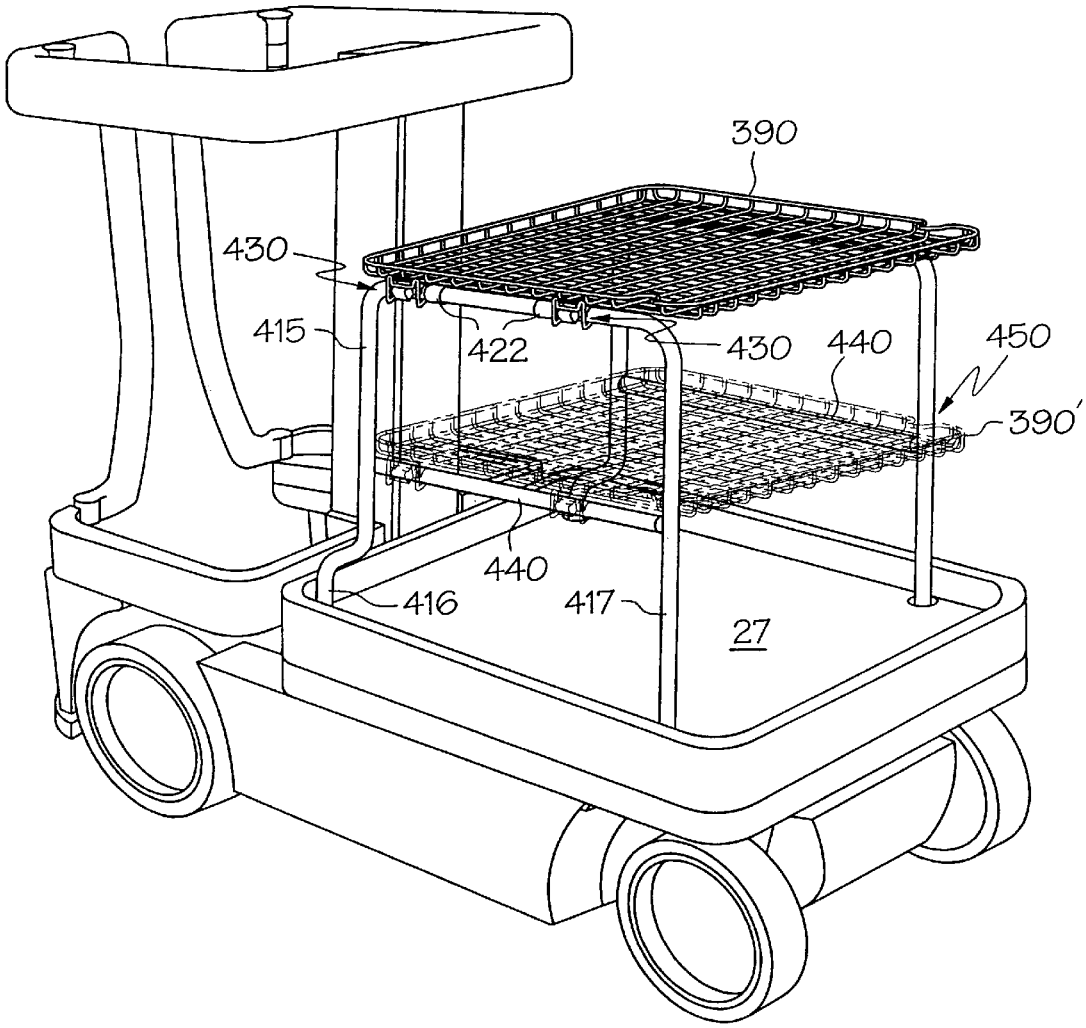
FIG. 10 is a perspective view from the front of a personnel carrying vehicle illustrating the load shelf arrangement of FIG. 9.
Figure 11:
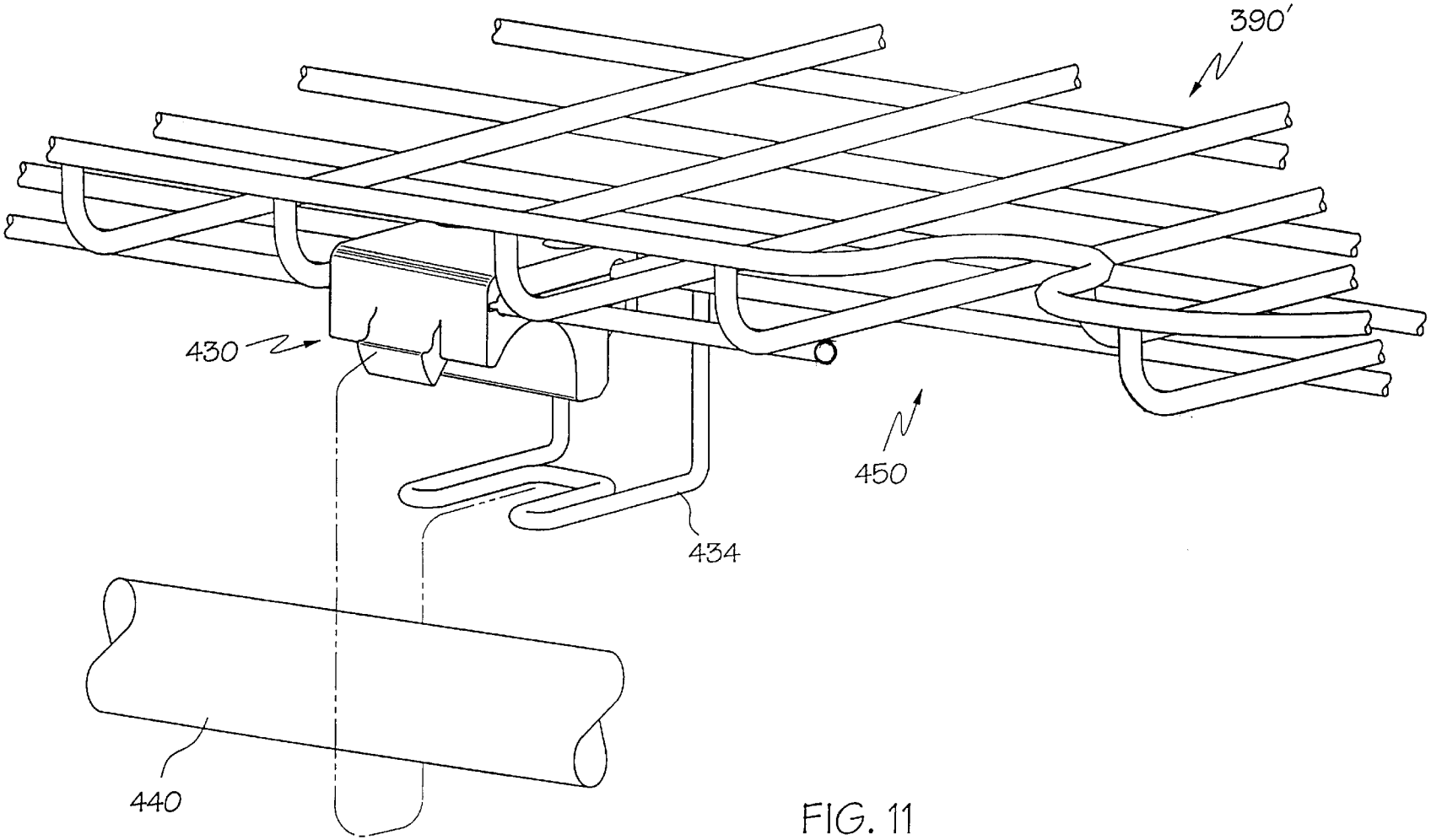
FIG. 11 is a perspective view illustrating clamping devices used for the load shelf arrangement of FIGS. 9 and 10.
Figure 13:
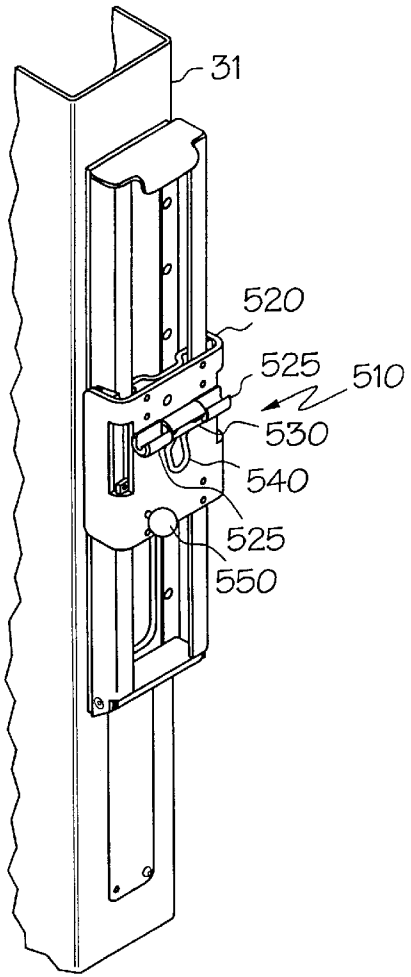
FIG. 13 is a perspective view of the load tray retaining mechanism of FIGS. 12 and 12A without a load tray but with the mechanism shown in its closed, tray retaining position.
Figure 12A:
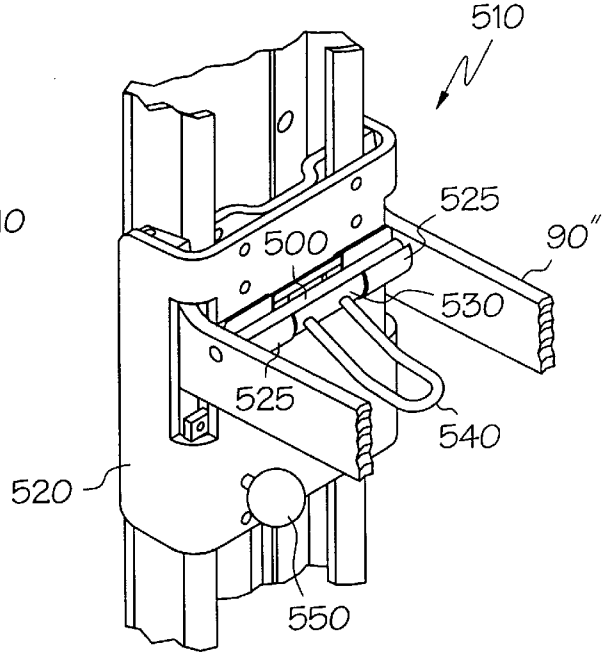
FIG. 12A is a perspective view of the open load tray retaining mechanism with a removable load tray received within the mechanism.
Figure 12:
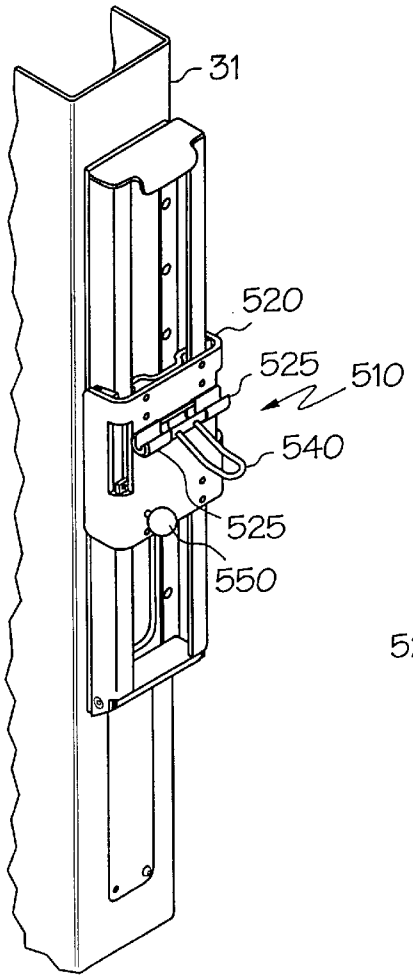
FIG. 12 is a perspective view of a load tray retaining mechanism opened for receiving a removable load tray of the present application.
Figure 14:
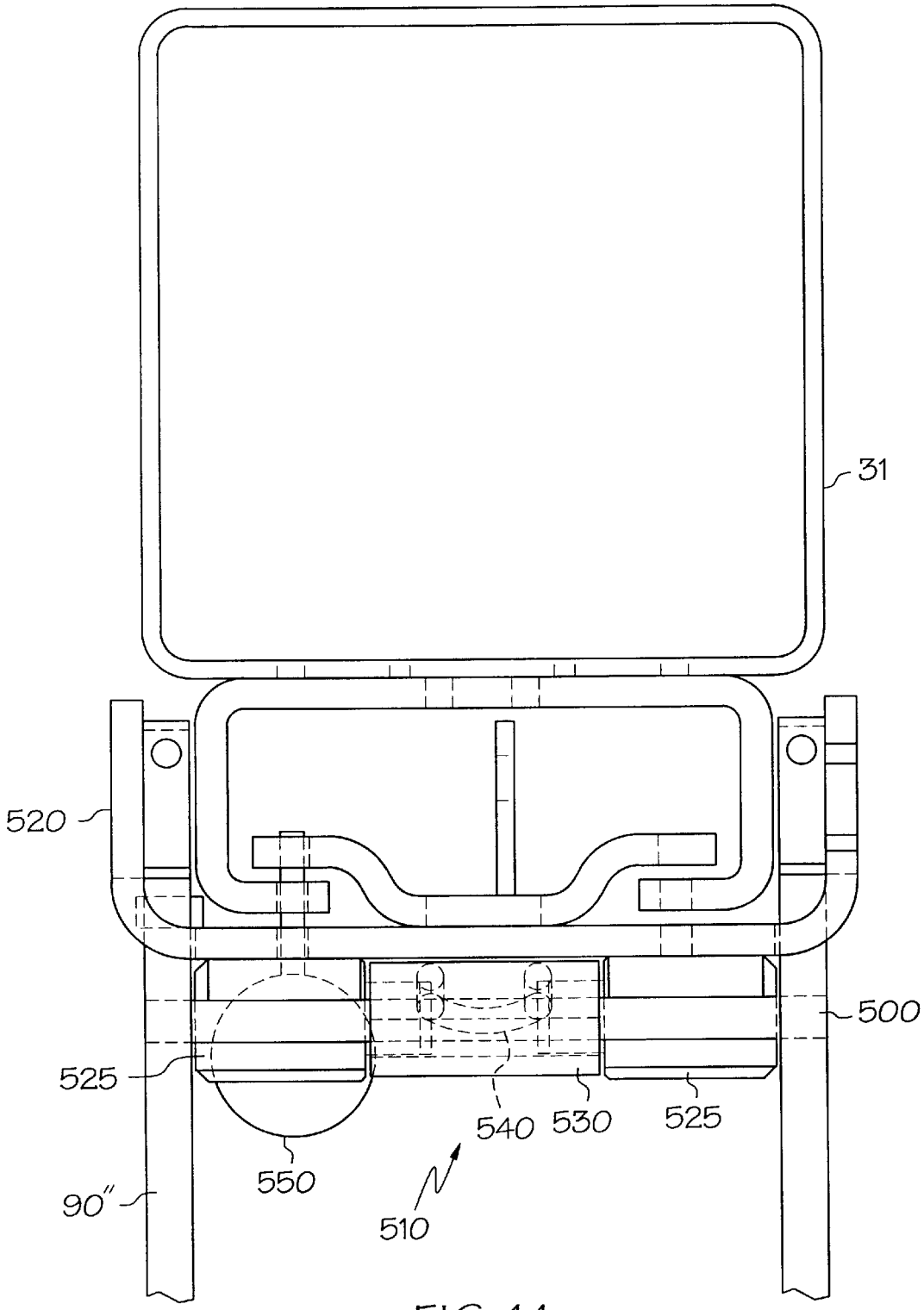
FIG. 14 is a plan view of the retaining mechanism of FIG. 12A in its closed position.
Figure 15:
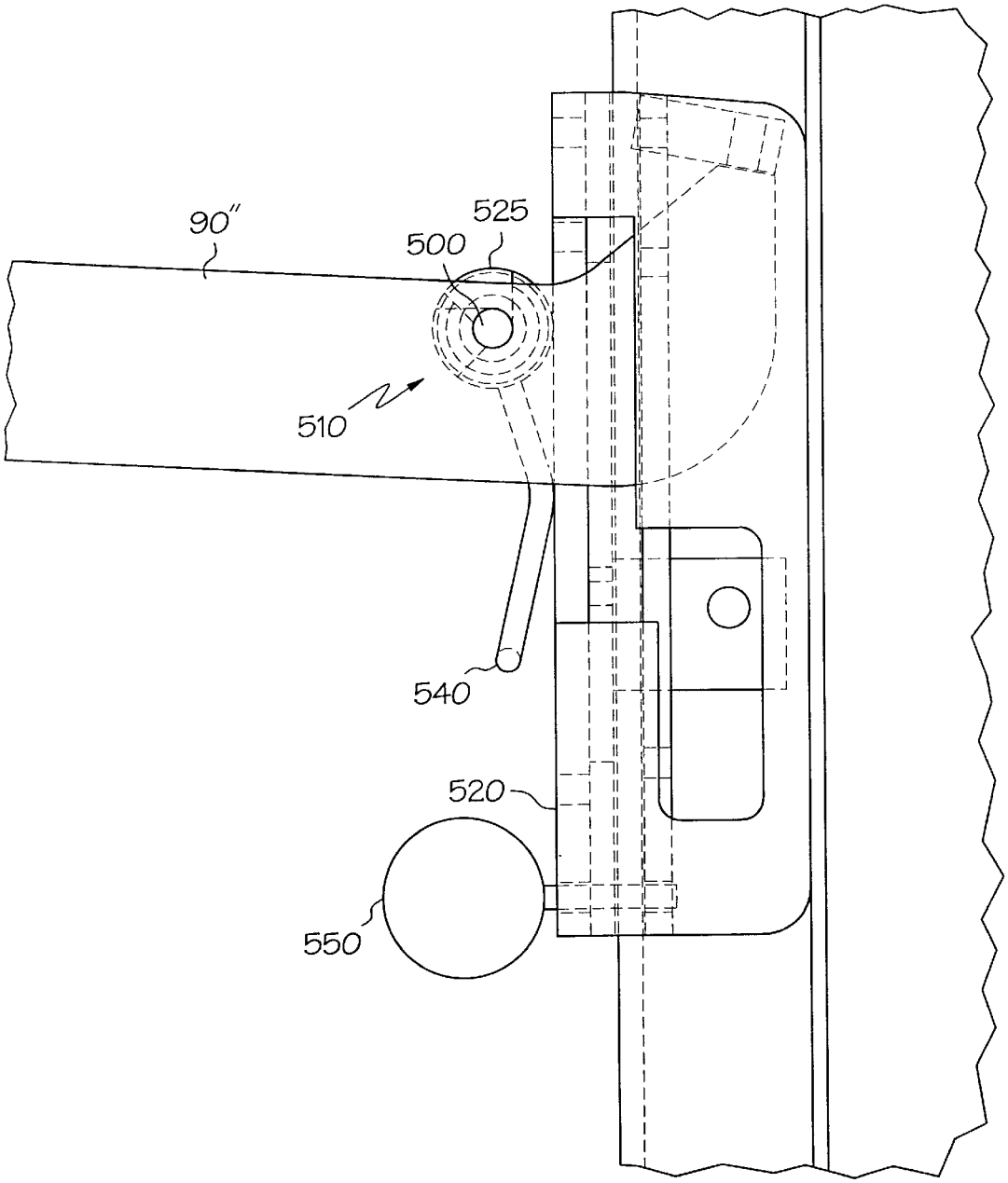
FIG. 15 is a side elevational view of the retaining mechanism of FIGS. 12A and 14 with a tray received within the mechanism and the mechanism in its closed position.

Another type of load shelf is shown in FIGS. 9–11 wherein a load shelf 390 is placed in a fixed position and is supported by a pair of support members 400 extending upwardly from the load platform 27. Openings 405 are provided in the load platform 27, and below these openings 405 are receptacles 410 which receive the ends of the members 400, see FIG. 9. The vertical components 415 of the support members 400 adjacent to the mast 30 terminate in curved lower ends 416 and the remaining portions of the vertical components 415 are slanted to match the slant of the mast 30. The curved lower ends 416 and angular slant of the remaining portions of the vertical components 415 provide room or clearance for the load tray 90 when stowed in an upright or vertical position as described above. The vertical components 417 at the left, or at the front of the vehicle, are straight, but also slanted to match the slant of the mast 30.

The top sections 420 of the support members 400 are horizontal and are each provided with two fixed, elongated rings or enlargements 422 which properly position a load shelf 390 placed on the top sections 420. The load shelf 390 is preferably made of heavy wire with vertical sides that extend upwardly. As shown, the spacing of the wires forming the load shelf 390 is approximately one and one-half inches, but any spacing can be used. Also, the floor of the load shelf 390 can be made solid, if desired.

Four clamping devices 430 are mounted on the load shelf 390, see FIGS. 9–11. The clamping devices 430 are molded from a plastic material and include an upper section that has the same diameter as the horizontal top sections 420 of the support members 400. A strap 434 extends from one side of each clamping device 430 around the bottom of one of the horizontal top sections 420 and snaps to the clamping device 430 on the other side of the top section to hold the load shelf 390 securely in place. The rings 422 have a diameter larger than the inside diameter of the clamping devices 430, making it impossible to install the clamping devices 430 on the rings 422. This arrangement ensures that the load shelf 390 is properly positioned before being secured in place.

In FIGS. 9 and 10, second horizontal rail members 440 are also used. The rail members 440 are each provided with a pin 442 that protrudes from one end thereof, and a spring loaded pin 444 that extends from the other end thereof. One pin may be received into an opening in the vertical member 415, the other being received into a corresponding opening in the vertical member 417. Thus, a second load shelf 390' may be installed on the intermediate rail members 440. The second load shelf 390' may be in addition to the load shelf 390 installed on the top rail or top sections 420. As illustrated in FIG. 9, the vertical components 415, 417 of the support members 400 include holes 435 so that the shelf 390' may be mounted at any one of the three locations corresponding to the holes 435. Of course, all the holes 435 could be utilized to support up to three load shelves 390' in addition to the load shelf 390 installed on the top rail or top sections 420. While up to three load shelves 390' are possible as illustrated, it should be apparent that the number of load shelves 390' can vary from one to any reasonable number for a given application of the vehicle.

As shown in FIGS. 9 and 10, recesses 450 are formed near the front of the load shelf 390', one of the recesses 450 being formed on each side of the load shelf 390'. The recesses 450 have a diameter slightly greater than the diameter of the vertical component 417 of the support members 400, thus permitting the load shelf 390' to be installed at any or all of the intermediate levels along the support members 400. The recesses 450 also position the load shelf 390' properly with regard to the mast 30 when the load shelf 390' is installed on the rail members 440.

The vertically movable load tray 90 also may be installed on the mast 30 while load shelves 390' are installed on the vehicle. If the movable load tray 90 is horizontal and in its uppermost or highest position, it will be above the uppermost load shelf 390. The movable load tray 90 may also be raised or stowed in its near vertical, or storage position, against the mast 30, as shown in FIG. 5A and earlier described in which case there is sufficient clearance between the movable load tray 90 and the vertical components 415 of the support members 400 and the load shelves 390, 390'.

An embodiment including a removable load tray elevator assembly 520 is shown in FIGS. 12, 12A and 13–15. A horizontal shaft 500 is secured to a tray 90" with the shaft 500 being received into a retaining mechanism 510 mounted on the elevator assembly 520. The retaining mechanism 510 includes a pair of fixed receptacles 525, which are half or partial cylindrical members welded to the elevator assembly 520. A rotatable member 530 is mounted for rotation to the fixed receptacles 525 and provided with a handle 540 so that it may be moved from a position shown in FIGS. 12 and 12A where it is open to receive the shaft 500, to the position shown in FIGS. 13–15 where it is closed and encircles the shaft 500, thus retaining the shaft 500, and the tray 90", securely to the elevator assembly 520. In this embodiment, the elevator assembly 520 may be moved vertically by releasing a retaining pin 550.

Having thus described the invention of the present application in detail and by reference to preferred embodiments thereof, it will be apparent that modifications and variations are possible without departing from the scope of the invention defined in the appended claims.

What is claimed is:

1. A personnel carrying vehicle comprising:

a self propelled, steerable body having a front end and a rear end;

a mast attached to and extending upwardly from said body and behind a center of said body, said center being located intermediate said front end and rear end of said body, said mast having a plurality of sections including a lower mast section attached to said body and an upper mast section which is movable relative to said lower mast section to be extendable between a retracted position and a fully extended position;

a personnel compartment attached to said upper mast section and extending rearwardly from said mast over a rear portion of said body and toward said rear end of said body, said personnel compartment being secured to said upper mast section so that said personnel compartment and said upper mast section move as one between a retracted position and a fully extended position;

a load deck mounted on said body and extending forwardly over a front portion of said body from said mast to said front end of said body and from side to side of said body for supporting articles to be carried on said body by said personnel carrying vehicle; and a load tray mounted to said upper mast section so that said load tray and said upper mast section move as one, said load tray extending forwardly from said upper mast section over a front portion of said body and being mounted to said upper mast section so that said load tray can be movably positioned at one of a plurality of vertical, operator selectable locations along said upper mast section.

2. A personnel carrying vehicle as claimed in claim 1 wherein said load tray is mounted to be readily removable from said upper mast section.

3. A personnel carrying vehicle as claimed in claim 1 wherein said load tray comprises:

a first section; and a second section pivotally mounted relative to said first section so that said second section can be folded onto said first section.

4. A personnel carrying vehicle as claimed in claim 3 wherein said load tray comprises a third section pivotally mounted relative to said first section so that said third section can be folded onto said first section, said first section being central to said load tray and said second and third sections being pivotally mounted to opposite sides of said first section.

5. A personnel carrying vehicle as claimed in claim 1 wherein said load tray is pivotally mounted to said upper mast section, said load tray being pivoted toward said upper mast section for vertical storage of said load tray and pivoted away from said upper mast section to substantially horizontal for deployment of said load tray.

6. A personnel carrying vehicle as claimed in claim 5 wherein said load tray is pivoted upwardly for vertical storage.

7. A personnel carrying vehicle as claimed in claim 1 wherein said vehicle further comprises at least one load shelf supported above and spaced from said load deck.

8. A personnel carrying vehicle as claimed in claim 7 further comprising a pair of support members having a generally inverted U-shape extending upwardly from said load deck and wherein said at least one load shelf comprises a load shelf supported upon a closed end of said pair of support members.

9. A personnel carrying vehicle as claimed in claim 8 further comprising a pair of horizontal rail members, a first one of said pair of rail members extending between upwardly extending legs of a first one of said pair of support members and a second of said pair of rail members extending between upwardly extending legs of a second one of said pair of support members, said at least one shelf further comprising a supplemental load shelf supported upon said pair of horizontal rail members.

10. A personnel carrying vehicle comprising:

a self propelled, steerable body having a front end and a rear end;

a mast attached to and extending upwardly from said body and behind a center of said body, said center being located intermediate said front end and rear end of said body, said mast having a plurality of sections including a lower mast section attached to said body and an upper mast section which is movable relative to said lower mast section to be extendable between a retracted position and a fully extended position;

a personnel compartment attached to said upper mast section and extending rearwardly from said mast over a rear portion of said body and toward said rear end of said body, said personnel compartment being secured to said upper mast section so that said personnel compartment and said upper mast section move as one between a retracted position and a fully extended position; and a load tray mounted to said upper mast section so that said load tray and said upper mast section move as one, said load tray extending forwardly from said upper mast section over a front portion of said body and being mounted to said upper mast section so that said load tray can be movably positioned at one of a plurality of vertical, operator selectable locations along said upper mast section.

11. A personnel carrying vehicle as claimed in claim 10 wherein said load tray is mounted to be readily removable from said upper mast section without the use of tools.

12. A personnel carrying vehicle as claimed in claim 10 wherein said load tray is pivotally mounted to said upper mast section, said load tray being pivoted toward said upper mast section for vertical storage of said load tray and pivoted away from said upper mast section to substantially horizontal for deployment of said load tray.

13. A personnel carrying vehicle as claimed in claim 12 wherein said load tray is pivoted upwardly for vertical storage.

14. A personnel carrying vehicle as claimed in claim 10 further comprising:

a mechanism mounted on and movable with said upper mast section for supporting said load tray, said mechanism comprising:

an elevator; and a member mounted on and movable with said upper mast section, said elevator being mounted to said member for movement along said member and said load tray being mounted to said elevator.

15. A personnel carrying vehicle as claimed in claim 14 wherein said load tray is removably mounted to said elevator.

16. A personnel carrying vehicle as claimed in claim 14 wherein said load tray supporting mechanism further comprises at least one spring extending between said member and said elevator.

17. A personnel carrying vehicle as claimed in claim 14 wherein said load tray is pivotally mounted to said elevator, said load tray being pivoted to enable movement of said elevator along said member.

18. A personnel carrying vehicle as claimed in claim 17 wherein said elevator further comprises a load tray support pin which engages an opening in said member when said tray is horizontal and is withdrawn from said opening in said member when said tray is pivoted to a release position.

19. A personnel carrying vehicle as claimed in claim 18 wherein said member includes a plurality of openings defining a corresponding plurality of positions for said load tray along said member.

20. A personnel carrying vehicle as claimed in claim 10 wherein said load tray comprises:

a first section; and a second section pivotally mounted relative to said first section so that said second section can be folded onto said first section.

21. A personnel carrying vehicle as claimed in claim 20 wherein said load tray comprises a third section pivotally mounted relative to said first section so that said third section can be folded onto said first section, said first section being central to said load tray and said second and third sections being pivotally mounted to opposite sides of said first section.

* * * * *